US007575398B2

(12) United States Patent
Lloyd et al.

(10) Patent No.: US 7,575,398 B2
(45) Date of Patent: Aug. 18, 2009

(54) AUTOMATIC SPOTTER WITH ELECTRONIC CONTROL SYSTEM FOR PILE DRIVING AND CONTINUOUS FLIGHT AUGER DRILLING LEADS

(75) Inventors: Peter Lloyd, Port Credit (CA); William F Stark, Uxbridge (CA)

(73) Assignee: Deep Foundations Contractors, Inc, Ontario (CA)

( * ) Notice: Subject to any disclaimer, the term of this patent is extended or adjusted under 35 U.S.C. 154(b) by 409 days.

(21) Appl. No.: 11/465,171

(22) Filed: Aug. 17, 2006

(65) Prior Publication Data

US 2008/0044236 A1 Feb. 21, 2008

(51) Int. Cl.
*E21B 19/24* (2006.01)
*E02B 13/00* (2006.01)

(52) U.S. Cl. ..... 405/232; 175/162; 173/6; 173/44; 173/183; 173/190

(58) Field of Classification Search ..... 405/232; 175/162, 195; 173/6, 39, 42, 44, 183, 190, 173/193
See application file for complete search history.

(56) References Cited

U.S. PATENT DOCUMENTS 3,481,409 A * 12/1969 Bengt ..... 173/193
3,550,693 A 12/1970 Bermingham
3,888,317 A 6/1975 Walters
4,102,094 A 7/1978 MacKinnon
4,274,494 A * 6/1981 Bergstrom ..... 173/2
4,470,635 A * 9/1984 Paurat et al. ..... 299/1.8
4,484,637 A * 11/1984 Mayer ..... 173/2
4,542,794 A * 9/1985 Bjor ..... 173/1
4,793,421 A * 12/1988 Jasinski ..... 175/27
4,799,556 A * 1/1989 Foster et al. ..... 173/193
5,396,964 A * 3/1995 Shellhorn et al. ..... 175/195
5,449,047 A * 9/1995 Schivley, Jr. ..... 175/27
5,474,142 A * 12/1995 Bowden ..... 175/27
5,896,936 A * 4/1999 Hakkinen et al. ..... 173/193

* cited by examiner

*Primary Examiner*—Tara Mayo-Pinnock
(74) *Attorney, Agent, or Firm*—Michael P. Mazza, LLC

(57) ABSTRACT

A lifting device such as a mobile crane having a main body and a boom, such as a lattice boom, for supporting a pile lead for, e.g., pile driving or continuous flight auger drilling, and a method of using same. A hydraulically operated mechanical spotter arm may be attached between the device body and the pile lead. Electronic position sensors on the spotter arm may be used to measure angular relationships between the pile lead and the spotter arm. Position sensors on a boom box on the boom may also be used. When the pile lead is swung, information from the sensors may be used by an electronic control system to automatically maintain the pile lead in a desirable position, limiting torque induced in the boom. The boom box position sensors may be used to counter-steer the spotter arm to further limit torque. The boom box may also be fitted with rubber springs to permit controlled pile lead deflection while limiting load transmitted to the boom. Other aspects of the invention will become apparent from the disclosure.

16 Claims, 9 Drawing Sheets

AUTOMATIC SPOTTER WITH ELECTRONIC CONTROL SYSTEM FOR PILE DRIVING AND CONTINUOUS FLIGHT AUGER DRILLING LEADS

BACKGROUND OF THE INVENTION

The present invention generally relates to improved crane operation. More specifically, the invention relates to an electronic control system that prevents the crane's operator from overstressing the lattice boom when operating the hydraulic spotter and provides continuous, self-compensation against spotter hydraulic system leakage (hydraulic drift) caused by the pile lead being twisted when continuous-flight-auger (CFA) drilling or pile driving.

Pile driving and CFA drilling are well-established methods that have changed very little in basic principle since their introduction many years ago, as described in U.S. Pat. Nos. 3,550,693, 3,888,317 and 4,102,094, each incorporated by reference herein in its entirety. The crane's operator requires considerable skill if major equipment damage is to be prevented when pile driving at acute angles. This is of particular importance during sideways battered piles. Incorrect operation can cause catastrophic failure through twisting and/or side loading of the crane's lattice boom if the spotter is not operated in the correct manner. Lattice booms are generally designed to work with compressive loads.

A spotter is a hydraulically-operated mechanical arm attached between the front end of a mobile crane and a pile lead. The spotter is designed to hold the pile lead at the proper inclination and handle overhanging loads while pile driving, and reactive torque while CFA drilling. The pile lead is generally attached to the top of the crane's lattice boom by an upper two-axis (x and z) pivoting boom box. The hydraulic spotter is designed to swing, extend and retract the lower portion of the pile lead, while the upper two-axis boom box allows movement between the pile lead and the crane's lattice boom.

Hydraulic spotters are generally manual or a automatic in operation. Automatic spotters feature a hydraulic steering system that keeps the pile lead's front attachment face (flange) at 90 degrees to the crane's boom centerline while the spotter is being operated (swung from side to side), thereby preventing excessive stressing to the crane's lattice boom. This system can, over time, get out of phase (due to hydraulic oil leaking past the cylinder's packing and valves) and is unable to self-compensate. The hydraulic system must be bleed manually to bring the system back into phase.

Sliding frames or "sliders" may be used to attach pile driving hammers and auger drilling attachments to the front face or flange of the pile lead. The attachments may be raised and lowered by a steel cable and winch, powered by the crane.

The following problems have, until now, caused considerable damage to the crane's lattice boom and the pile lead's mechanical structures when using the standard two-axis upper boom box and spotter with manual and/or self-steering control:

1. The pile lead is not in constant alignment with the crane's boom tip when operating the spotter, as the crane's operator is unable to properly judge the pile lead's alignment with the crane's boom tip. This is most common during sideways batters when the spotter is swung out from under the lattice boom.
2. The spotter's hydraulic system drifts over time, given normal oil leakage, causing the pile lead to twist and/or side-load the crane's lattice boom.

3. The crane's boom is subjected to twist and/or side loading caused by torque reaction when CFA drilling or pile driving at acute angles.

Resulting twisting or side loading of the crane's lattice boom caused by these conditions can cause catastrophic failure, personal injury and even death.

Accordingly, it would be advantageous to provide apparatus and a method for improving crane operation to solve the above-referenced problems, and the present invention is believed to do so, as explained below.

SUMMARY OF THE INVENTION

The present invention relates to a three-axis (x, y and z) pivoting boom box with or without progressive rate rubber springs and at least one electrical feedback sensor attaching the lead to the top of the crane's lattice boom, for use in limiting the maximum amount of twist and/or side loading transmitted into the crane's lattice boom. The hydraulic spotter is designed to swing, extend and retract the lower portion of the pile lead, while the upper three-axis boom box allows movement between the pile lead and the crane's lattice boom. The hydraulic spotter is designed (programmed) to remain in proper phase and also to self-compensate for external forces and hydraulic leakage.

An onboard electronic control module (ECM), mounted in the crane's cab, preferably processes all operator inputs, which may be supplied from an electric, hand-operated joystick located near the crane's operator.

The electronic control system is designed to keep the pile lead's front attachment face (flange) at about 90 degrees to the crane's boom centerline while the spotter is being operated, thereby preventing excessive stressing to the crane's lattice boom. The spotter may use two or more electronic sensors to measure the angle between the pile lead and the spotter's mainframe. The electronic sensors may be linear (LVDT) or rotary in operation and either analog or digital. The ECM may be programmed to accommodate most types. The spotter's mainframe, as well as the crane's lattice boom, may be attached to the crane's revolving mainframe.

The electronic control system may be designed to detect normal hydraulic leakage in the spotter's hydraulic system while pile driving at acute side angles, or when CFA drilling for extended periods. The two or more electronic sensors may be used to measure the angle between the pile lead and the spotter's mainframe to detect hydraulic drift.

The electronic control system may also be used to detect twist in the pile lead assembly (typically 80 ft. to 100 ft. long), particularly when CFA drilling with the auger's hydrostatic drive and reduction box at the upper portion of the pile lead, located adjacent the boom box. Some amount of pile lead twist is normal and is dependent upon the amount of torque required to turn the CF auger into the ground, and the mechanical structure of the pile lead. The spotter, which may be attached to the bottom of the pile lead, may be up to 70 ft. away from the auger's hydrostatic drive and reduction box, causing the pile lead to twist, which in turn rotates the upper boom box in relation to the crane's lattice boom assembly. An electronic sensor may be used to measure the twist between the pile lead and the crane's boom.

Persons of ordinary skill in the art will recognize that the electronic sensors may be replaced with hydraulic sensors (manual or pilot operated) to provide hydraulic feed-back to the spotter's main hydraulic control valves. It is believed, however, that the ECM controlled system will allow greater control and monitoring and also provide operator warnings/shutdown in case of system malfunction.

In one preferred embodiment of the invention, a mobile crane is provided having a lattice boom supporting a pile lead. A hydraulically-operated mechanical spotter arm may be attached between the crane body and the pile lead. The spotter arm may include a distal portion with an extendable and retractable stinger connected to the pile lead. At least two electronic position sensors associated with the spotter arm and used to measure angular relationships may be located between the pile lead and the spotter arm. One of the electronic positions sensors, which may be positioned adjacent a centerline of the spotter arm, may be used to monitor pile lead-induced torque in the boom, while another, which may be positioned adjacent the spotter arm centerline and on an opposing side of the centerline from the first sensor, may be used to monitor angular position of the spotter arm, for example. An electronic control system may be provided in electrical communication with the electronic position sensors. When the pile lead is swung left or right of a centerline of the crane, information from the sensors may be used by the electronic control system to automatically maintain a front face of the pile lead approximately perpendicular to the centerline, thereby limiting torque induced in the boom during crane usage.

A boom box may be connected to the boom. The boom box may have one or more associated electronic position sensors in electrical communication with the electronic control system, enabling monitoring of pile lead induced torque in the boom, and permitting corresponding, automatic counter-steering of the spotter arm to limit the torque. Using the boom box, for example, pile-lead induced torque in either clockwise or counterclockwise directions may be measured.

The spotter arm may include a spring-retractable hose reel housing hydraulic hoses for supplying hydraulic oil to hydraulic cylinders controlling movement of the spotter arm. One or more electrical cables may be molded together with the hydraulic hoses, wrapped around the hose reel, and attached to the distal stinger of the spotter arm, so that extension of the stinger pulls the hose/cable assembly, rotating the hose reel and tensioning its spring.

In an alternative embodiment, the boom box may be fitted with one or more rubber springs enabling controlled pile lead deflection in either or both of clockwise or counterclockwise directions while limiting load transmitted to the boom to a maximum allowable load. The rubber springs may have the same or different load ratings, and may also be removable, allowing the boom box to freely pivot on all three axes. The load ratings of the rubber springs may range from between about 6,000-125,000 pounds of force, for example. It may be desirable to have the load rating(s) of the rubber spring(s) employed when pile-lead deflection is in the clockwise direction differ from the load rating(s) of the rubber spring(s) employed when pile-lead deflecting in the counterclockwise direction. A pivoting spring seat operatively attached to the boom box may be employed to permit compression of the rubber spring(s) while limiting their pinching or side-loading.

The electronic control system may be used to monitor deflection in the rubber spring(s) and, based at least in part on this feedback, limit the ability of a crane operator to control movement of the spotter arm. If the rubber spring(s) are removed, the electronic control system may be used to enable a crane operator to control movement of the spotter arm. The electronic control system can also enable automatic calibration of the positions sensors associated with the spotter arm and the boom box. Calibration may include the calculation of spotter arm locations corresponding to minimum and maximum voltages provided by the position sensors and account for clockwise and counterclockwise movement of the spotter arm. The crane operator may be permitted to control movement of the spotter arm during calibration. The electronic control system may also be used to detect predetermined out-of-limits operation for the crane and to warn a crane operator in this event.

In yet another alternative embodiment of the present invention, a method is provided for using a mobile crane having a lattice boom supporting a pile lead. A hydraulically-operated mechanical spotter arm is first provided, and attached between the crane body and the pile lead. At least two electronic position sensors associated with the spotter arm are also provided, as is an electronic control system in electrical communication with these sensors. The electronic control system and the spotter arm electronic position sensors may be used to obtain angular information based on measuring angular relationships between the pile lead and the spotter arm when the pile lead is swung to the left or right of a centerline of the crane. The electronic control system and the angular information may now be used to automatically maintain a front face of the pile lead approximately perpendicular to the centerline, thereby limiting torque induced in the boom during crane usage. A boom box may also be provided, and connected to the boom. The boom box may have one or more associated boom box electronic position sensors in electrical communication with the electronic control system. Pile lead induced torque in the boom may be monitored and measured using the boom box electronic position sensor(s). The spotter arm may be automatically counter-steered using the electronic control system and the measured pile lead induced torque, to limit torque in the lattice boom.

Pile lead-induced torque in the boom may be monitored using a first of the spotter arm sensors, and monitoring angular positions of the spotter arm using a second of the spotter arm sensors. The spotter arm may be provided with a distal portion consisting of an extendable and retractable stinger connected to the pile lead. Pile-lead induced torque in the spotter arm may be measured in either clockwise or counterclockwise directions.

A boom box connected to the boom and in electrical communication with the electronic control system may also be provided, and fitted with one or more rubber springs, enabling controlled pile lead deflection in either or both of clockwise or counterclockwise directions while limiting load transmitted to the boom to a maximum allowable load. The rubber spring (s) may have differing load ratings, and may be removable to allow the boom box to freely pivot on all three axes (x, y and z). The load ratings of the rubber spring(s) may range from between about 6,000-125,000 pounds of force, for example. The load rating(s) of the one or more rubber springs employed when pile-lead deflection is in the clockwise direction may differ from the load rating(s) of the one or more rubber springs employed when pile-lead deflecting in the counterclockwise direction. The rubber springs may also be compressed while limiting their pinching or side-loading, using for example a pivoting spring seat operatively attached to the boom box. Deflection in the rubber spring(s) may be monitored using the electronic control system and, based at least in part on this feedback, the ability of a crane operator to control movement of the spotter arm may be limited. Also, the rubber spring(s) may be removed, and the electronic control system may be used to enable a crane operator to control movement of the spotter arm.

The spotter arm and boom box position sensors may be calibrated using the electronic control system. During calibration, the crane operator may be permitted to control movement of the spotter arm. Calibrating the position sensors may involve calculating spotter arm locations corresponding to minimum and maximum voltages provided by the position sensors and accounting for clockwise and counterclockwise movement of the spotter arm during such calculations.

The electronic control system may be used to detect predetermined out-of-limits operation for the crane and to warn a crane operator in this event.

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout the several views.

DEFINITION OF CLAIM TERMS

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

"Automatic" means performing the corresponding operation using an electronic or other control system, without the need for operator intervention.

DETAILED DESCRIPTION OF THE PREFERRED EMBODIMENTS

Set forth below is a description of what are believed to be the preferred embodiments and/or best examples of the invention claimed. Future and present alternatives and modifications to the preferred embodiments are contemplated. Any alternatives or modifications which make insubstantial changes in function, in purpose, in structure, or in result are intended to be covered by the claims of this patent.

Figure 1:
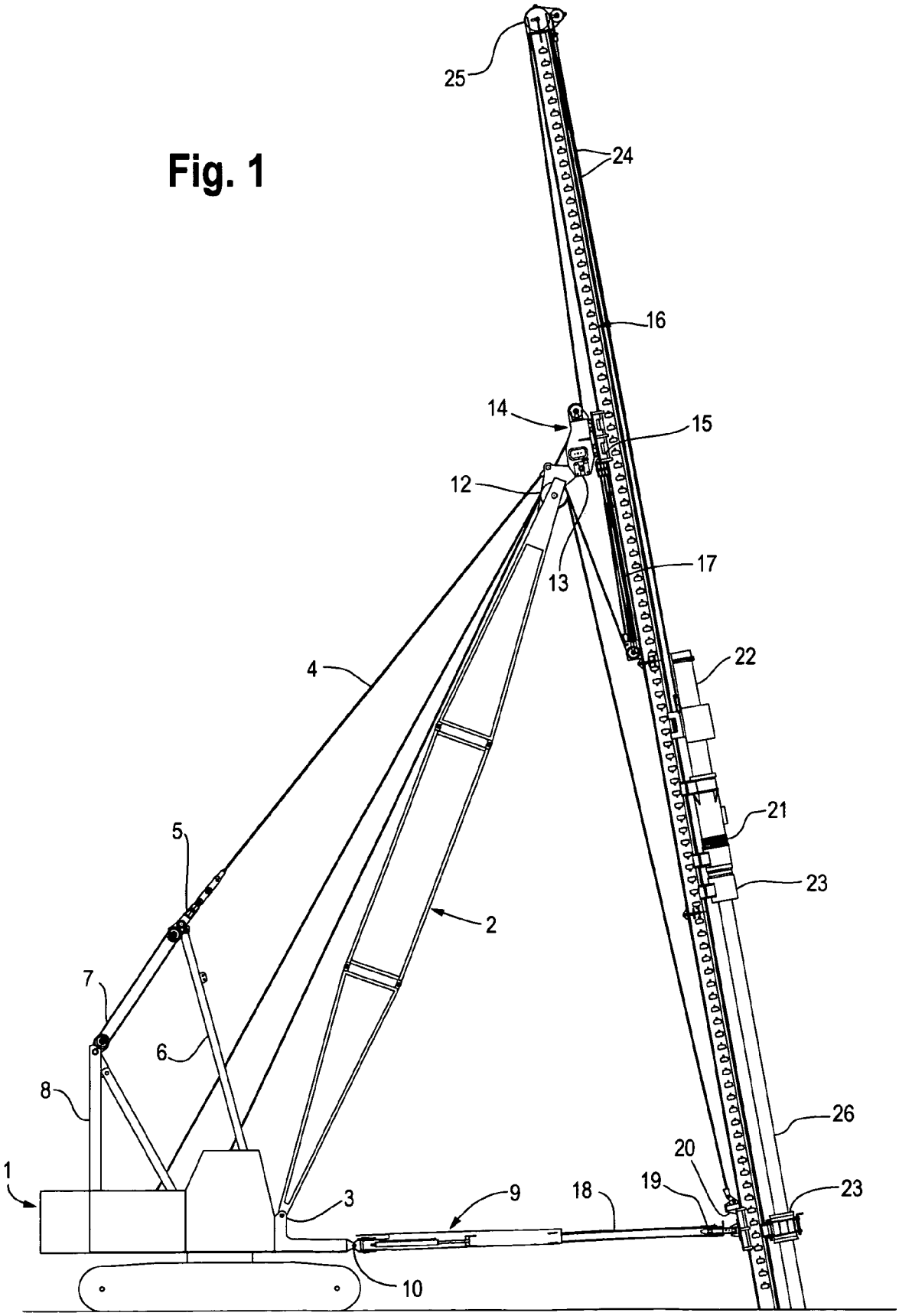
FIG. 1 is a side view of a crane and pile lead with a diesel hammer attached to the crane by a hydraulic spotter, shown fully extended, and three-axis boom box.

Referring first to the preferred embodiment of the invention shown in FIG. 1, a detailed description of this example follows, it being recognized that various other examples may be provided that are within the principles of the invention and intended to be covered by the claims. In the preferred example, lattice boom 2 may be attached to the mobile crane's revolving upper frame or base 1 by two pivot pins 3, which form the bottom boom pivot point, and at the top by pendent cables 4, spreader bar 5, live mast 6, multi-part cable 7 and gantry 8. Cable 7 may be spooled in and out by one of the crane's winches and may be used to raise and lower the lattice boom assembly.

Hydraulic spotter 9 may be attached to the crane's revolving upper frame 1 by pivot pins 10, allowing spotter 9 to be raised and lowered by cable 11, which is carried by the boom's top sheaves 12, located at the tip of the lattice boom 2. Cable 11 may also be spooled in and out by one of the crane's winches. Three-axis boom box 14 may be attached to the top of the lattice boom 2 by pin 13, and may be fitted with rubber springs. Pin 13 may be used to allow the boom box to rotate in the "Z" axis (allowing the pile lead's bottom end to be extended or retracted by the hydraulic spotter). Boom box slider 15 may be attached to boom box 14. Slider 15 may be mounted on two sets of pivot pins (not shown in the drawings), allowing the slider to rotate in both the "X" (horizontal) and "Y" (vertical) axes. Most known boom boxes do not allow the slider to pivot in the "Y" axis. Boom box slider 15 restrains the rear flange of pile lead 16 but allows the pile lead to slide in a generally vertical plane (raised and lowered in relationship to the ground). Cable 17 may run between two sheave blocks, one of which may be attached to boom box slider 15, while the other may be attached to pile lead 16. Cable 17 may be carried by top sheaves 12, which may be located at the tip of the lattice boom 2 and may be spooled in and out by one of the crane's winches. Spooling in the cable raises pile lead 16.

Hydraulic spotter 9 may be equipped with an extendable stinger 18, which may be moved in and out by a hydraulic cylinder, for example. Outer steering arm 19 may be attached to stinger 18. Arm 19 may be pivoted in the "Y" axis by two hydraulic cylinders. Bottom slider 20 may be attached to steering arm 19, and may be used to restrain the rear flange of pile lead 16, allowing the pile lead to slide in a generally vertical plane (raised and lowered in relationship to the ground). Bottom slider 20 may also be permitted to pivot in the "X" and "Z" plane on outer steering arm 19. The "Y" plane of the bottom slider may be the only plane that is hydraulically controlled. The pile lead may be raised and lowered by cable 17 or may remain stationary. The spotter assembly, including the lower slider, may be raised and lowered in relationship to the pile lead by cable 11. The hydraulic spotter may also be swung from side to side (e.g., by two hydraulic cylinders), allowing the crane's operator to position the bottom of the pile lead to either side of the crane's centerline. As spotter 9 is swung (in the "Y" plane), the outer steering arm must also be rotated in the "Y" plane (in the opposite direction and equal in degrees) in order to keep the pile lead's front face at a constant 90 degrees to the crane and boom's centerline. A more detailed description of hydraulic spotter 9 and boom box 14 with rubber springs is provided below.

Diesel hammer 22 and pile guide 23 may each be attached to the front face of pile lead 16 by sliders 21. A two-part steel cable 24 may run between a sheave block attached to the top slider of diesel hammer 22, and top sheave assembly 25 located at the top of pile lead 16. The cable may be spooled in ad out by one of the crane's winches. Spooling in the cable raises diesel hammer 22.

Figure 2:
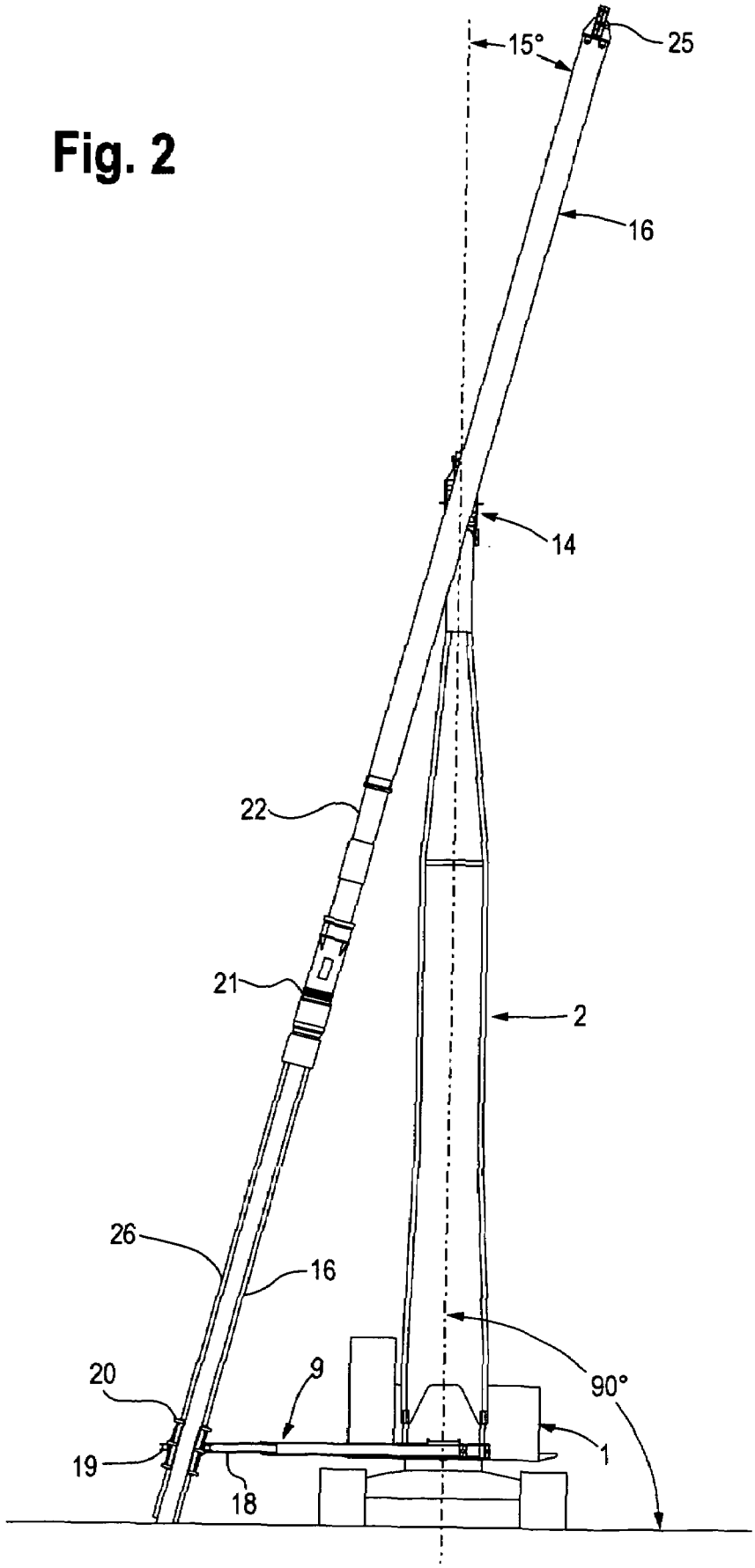
FIG. 2 is a front view of the crane shown in FIG. 1 with the spotter shown extended and fully swung.

Still referring to FIG. 1, diesel hammer 22 is shown, together with anvil 23 driving pile 26 into the ground. The operator may spool out cable 24 as the hammer drives the pile. Referring to FIG. 2, pile lead 16 and diesel hammer 22 may be fully swung to one side of the crane's centerline by spotter 9. As shown, boom box slider 15 has pivoted on boom box 14, while bottom slider 20 has also pivoted on outer steering arm 19 as the spotter was swung.

Figure 3:
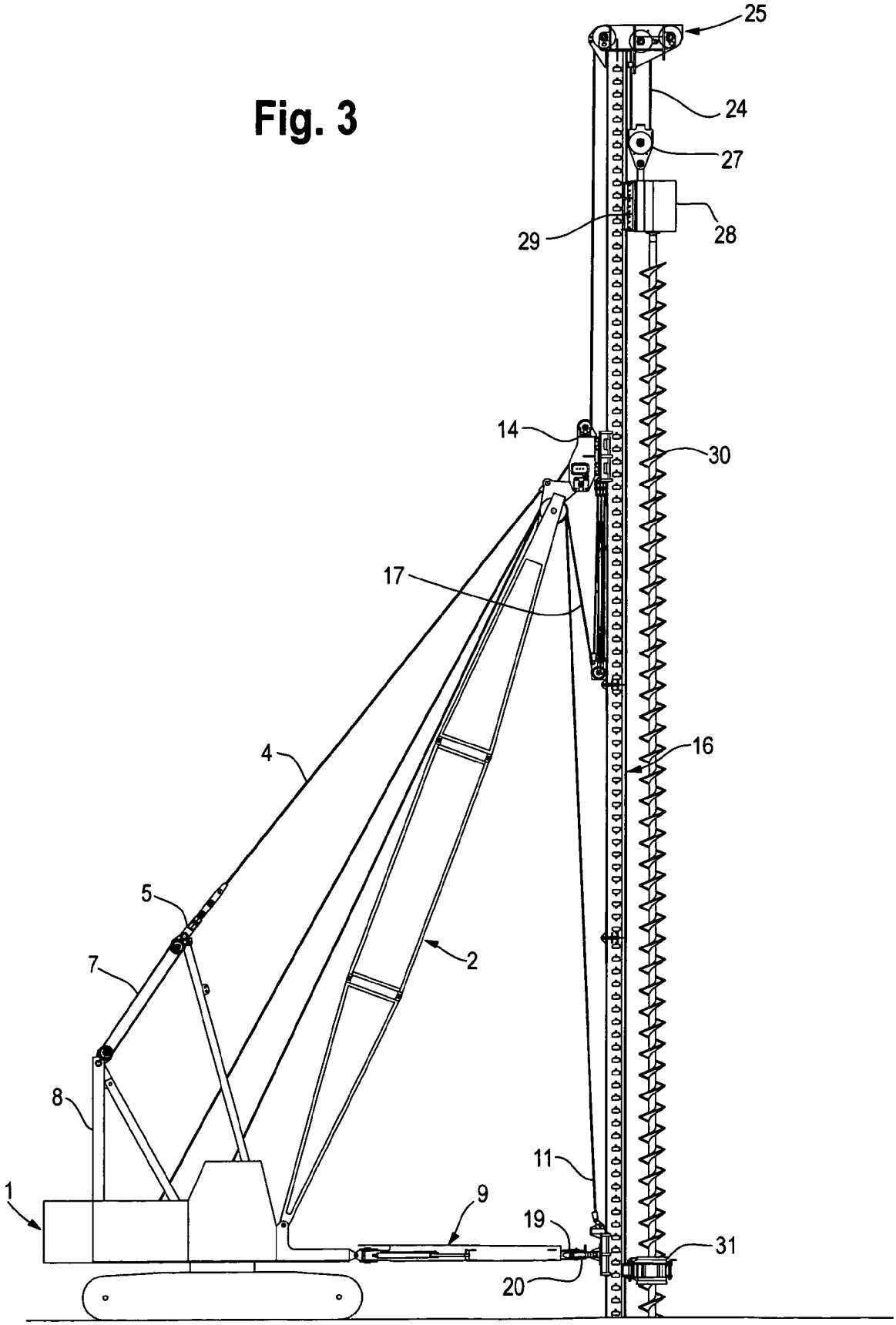
FIG. 3 is a side view of a crane and pile lead with a continuous-flight drilling auger attached to the crane by a hydraulic spotter and three-axis boom box, with the spotter shown in the fully retracted position.
Figure 4A:
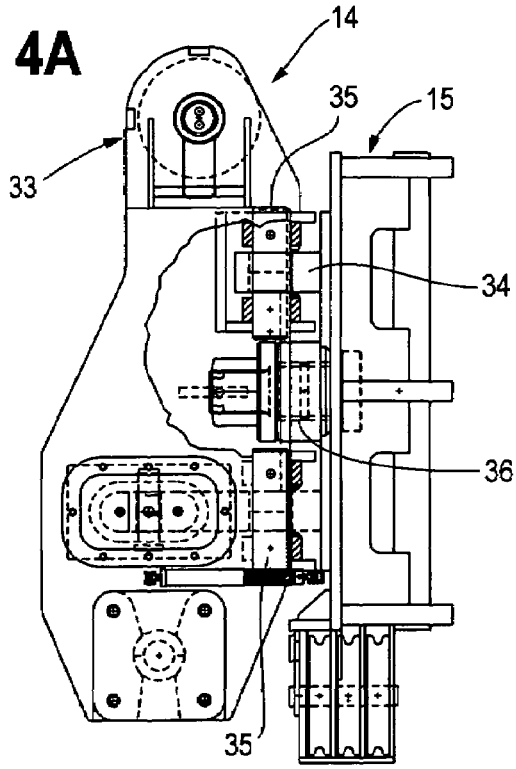
FIGS. 4A and 4B are side connected and side parts exploded views, respectively, of a three-axis boom box shown with rubber springs and electronic position sensor.
Figure 4B:
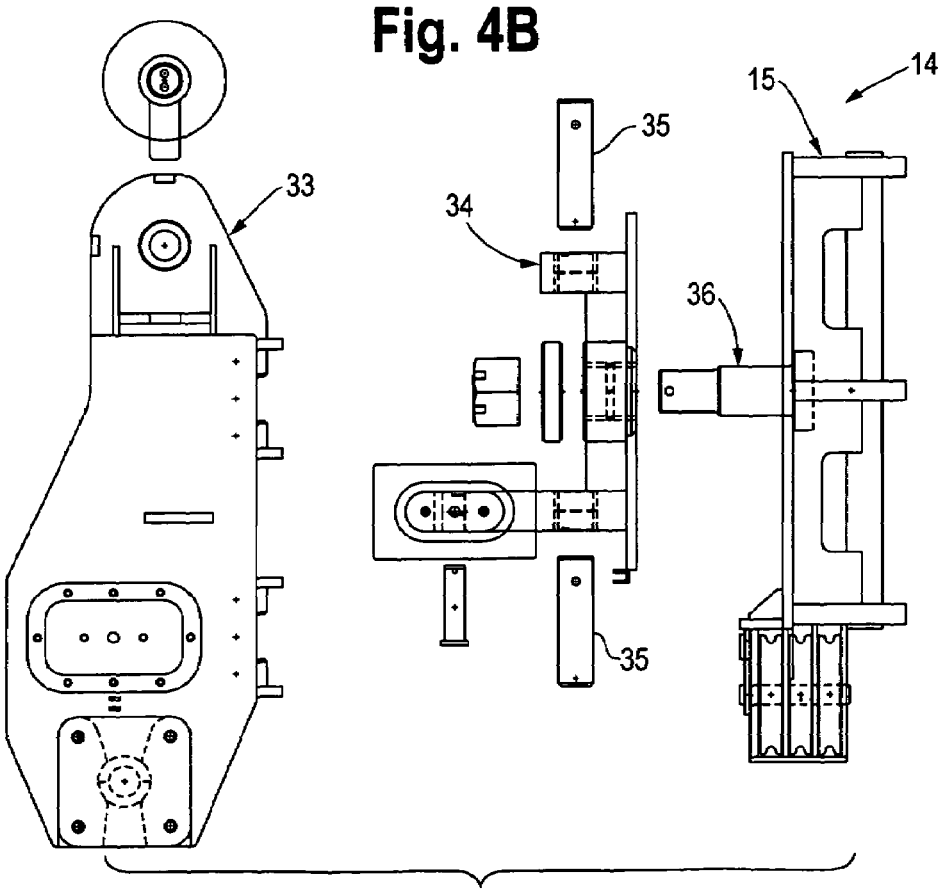
Figure 4C:
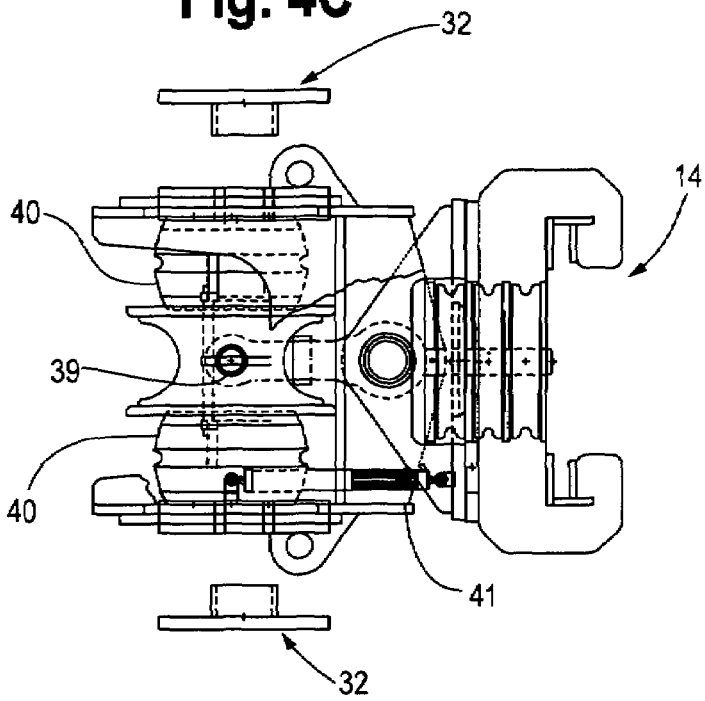
FIGS. 4C and 4D are end views, connected and exploded, respectively, of the three-axis boom box shown in FIGS. 4A-4B FIGS. 5A and 5B are non-rotated and rotated, respectively, end views of the three axis boom box with rubber springs and electronic position sensor, with FIG. 5A showing the boom box in-line with the crane's centerline and FIG. 5B showing it twisted by the pile lead.
Figure 4D:
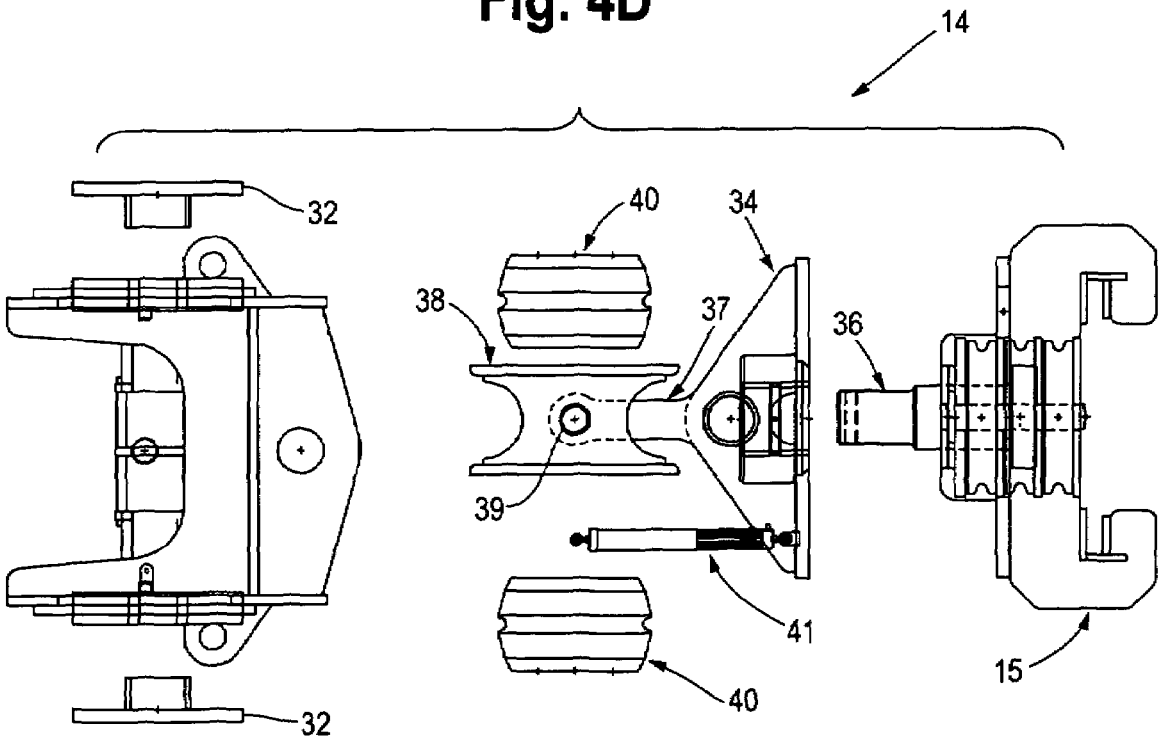

FIG. 3 shows pile lead 16 and a CFA drill attachment. The only attachment changes required when changing from pile driving to CFA drilling are the sheave assembly 25 attached to the top of pile lead 16, sheave block 27 (six part line) and hydrostatic-driven reduction drive box 28. Drive box 28 may be attached to pile lead 16 by sliders 29. CFA auger 30 may be attached to drive box 28. Auger guide 31 may be attached to the pile lead and may be used to guide the auger into the ground, thus preventing the auger from wandering. An auger cleaner (not shown) may be attached close to the auger guide (or may constitute part of the guide) and may be used to clean the auger's flights.

When CFA drilling, the spotter's operation may be as described above. Preferably, the pile lead's angle is generally close to the vertical position as shown in FIG. 3. Cable 24 may be spooled out as the auger screws itself into the ground. Spooling in pulls the auger and material, contained in the auger's flights, out of the ground. The auger may be reversed when out of the ground to throw off any remaining material not removed by the auger cleaner.

As mentioned before, the spotter may be physically attached to the crane and to the bottom of the pile lead. It is preferably designed to take full reactive torque when CFA drilling. It may be seen that when drive box 28 is towards the top of its travel, as shown in FIG. 3, the reactive torque transmitted to the pile lead will twist the pile lead to a greater degree than when it is towards the bottom of the pile lead, closer to the spotter. Fortunately, reactive torque is generally lower when the drive box is towards the top of the pile lead, and generally increases as the auger is screwed deeper into the ground. Known standard boom boxes only pivot in the "X" and "Z" planes, and such two-axis boom boxes will transmit reactive force to the crane's boom. A three-axis boom box (X, Y and Z) with rubber springs and electronic position sensor, which forms a preferred embodiment of the present invention, prevents reactive forces from damaging the crane's boom. Rubber springs (e.g., rectangular convolution type) such as those manufactured by Timbren are preferably progressive in rate and allow the reactive force to rotate the boom box by a few degrees without overloading the crane's boom. Various rubber grades may be selected to control the amount of force transmitted to the boom. In some conditions, the rubber springs may be removed, allowing the boom box free, unrestricted movement in all directions. This is not generally recommended as it makes assembly (rigging) and disassembly tricky, as the boom box may flop over on its side. The rubber springs are also beneficial in dampening reactive torque spikes when CFA drilling. They may have a rated capacity ranging from 6,000 to 110,000 lbs. force, for example. For CFA drilling, a Timbren A300-75 progressive rate rubber spring with a rated capacity of 45,000 lbs. and a bump load capacity of 110,000 lbs. may be selected, for example.

The electronic position sensor preferably monitors the deflection in the rubber springs in both the clockwise (CW) and counterclockwise (CCW) directions. The ECM may be programmed to monitor the position of the sensor. As pile lead deflection increases to a programmable set point, the ECM preferably energizes the hydraulic valve for the spotter's outer-steering arm 19. The outer-steering arm rotates the pile lead in the opposite direction to the reactive force, rotating boom box 14 and returning the electronic sensor to its null (0) position. Programming and rubber spring selection may be fine-tuned for various auger diameters, maximum auger lengths, and varying soil types and drive box powers (maximum output torque). Returning to FIGS. 1 and 2, it may be seen that when driving piles at an acute angle (front or sideways), the diesel hammer may be positioned in front of the vertical centerline of pile lead 16. When operating (FIG. 2) for long periods of time, hydraulic drift in the spotter's hydraulic system (cylinders and valves) can cause the pile lead to be rotated by the offset weight of the hammer, anvil and to some degree, the pile. This will transmit torque into the crane's boom when using a standard two-axis boom box. With a three-axis boom box of the preferred embodiment, fitted with rubber springs, and the electronic position sensor, the ECM can compensate for hydraulic drift and any other outside force that tends to influence the pile lead assembly. Until now, it has been up to the skill of the operator, gained through many years of experience, which has compensated for reactive and outside forces by using the hydraulic spotter and crane's controls. Even the most experienced operator has no way of knowing how much stress is being transmitted to the boom during pile driving or CFA drilling. Exceeding the boom's structural load limits can result in boom failure.

FIGS. 4A-4D show the boom box assembly 14 that attaches to the pile lead assembly. Pivot bushings 32 may be attached to the upper frame of boom box 33. Pivot bushings 32 may be attached to the top pivot pin (not shown) of the crane's lattice boom, allowing rotation of the boom box in the "Z" axis. Rotation in the "Z" axis is typical when extending or retracting stinger 18 of spotter 9. Upper frame 33 may be attached to lower frame 34 by two in-line pivot pins 35, allowing the lower frame to pivot in the "Y" axis in relation to the upper frame, thereby reducing any side loading and twisting to the crane's boom. Pivoting slider 15, which allows the pile lead 16 to be raised and lowered, may be attached to the lower frame 34 by pivot pin 36, allowing rotation in the "X" axis. It may be seen, now, that boom box 14 functions as a universal joint. Lower frame 34 has an extended arm 37, to which a pivoting spring seat 38 may be attached using a pivot pin 39. Spring seat 38 may be sandwiched between two hollow rubber springs 40 that are attached to upper frame 33. An electronic position sensor 41 may be attached between upper frame 33 and lower frame 34.

Figure 5B:
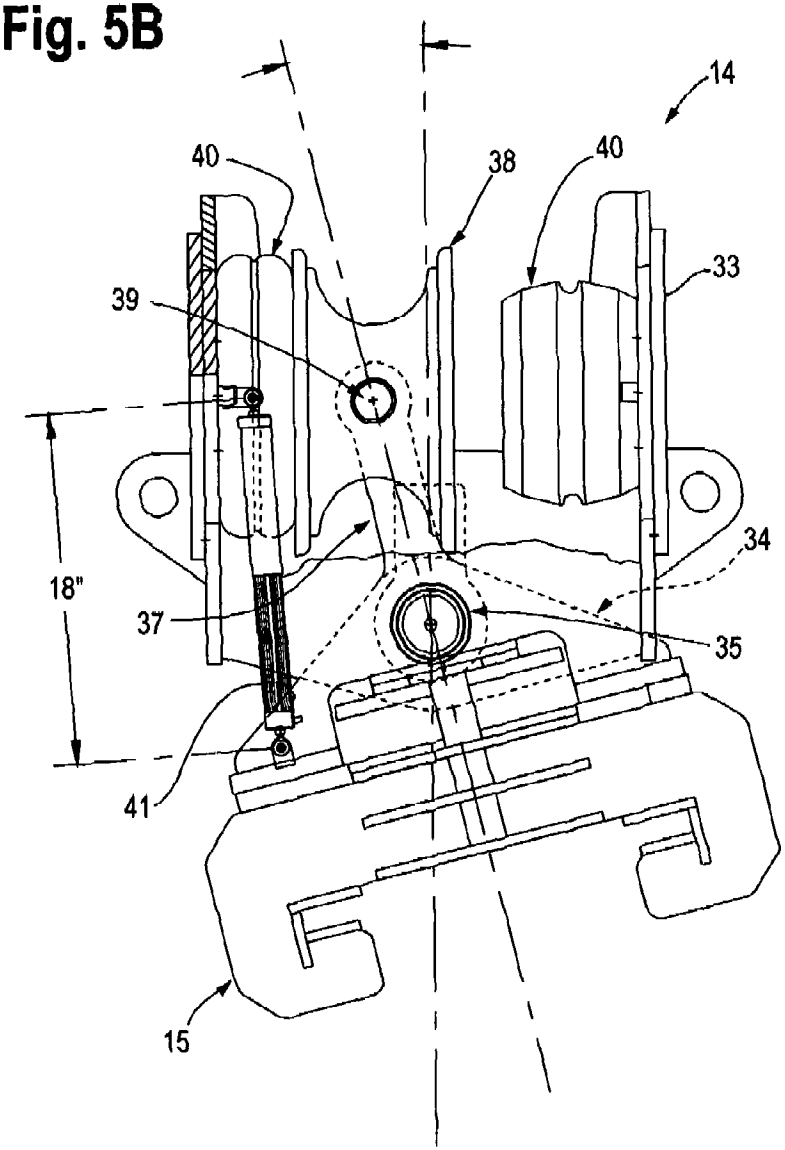
Figure 5A:
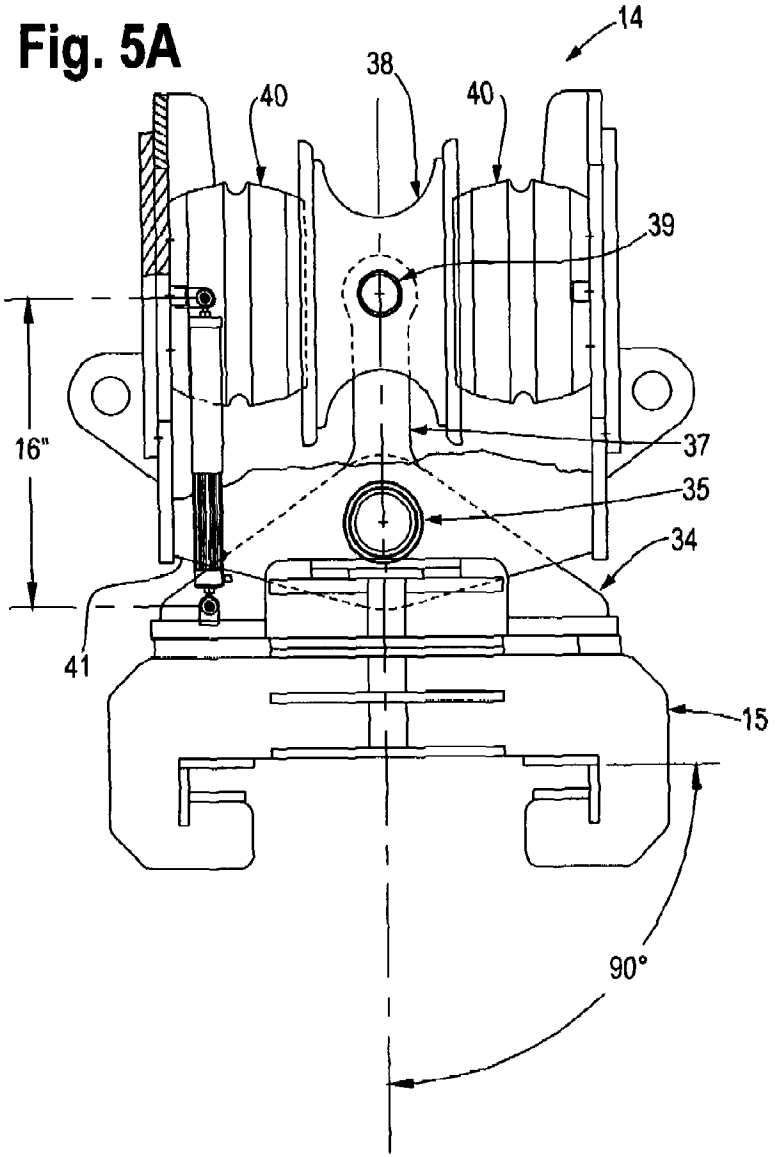

FIGS. 5A-5B show boom box assembly 14 with pivoting slider 15 offset ninety degrees to the centerline of the crane/boom and tilted 14 degrees (maximum deflection) from the crane's centerline. This amount of deflection would generally never be reached by the preferred embodiment of the invention described here due to the operation of the electronic control system. A preferred distance between the spherical joints of position sensor 41 at zero deflection was found to be 16 inches. The sensor's output voltage at 16 inches was determined to be 2.5 Volts. At maximum CCW deflection the sensor may be extended to 18 inches (4.5 Volt Max.). At maximum CW deflection, the sensor was found to measure 14 inches (0.5 Volts Min.). Rubber springs 40 provide a dampened and controlled movement, allowing the position sensor to accurately provide a feedback signal to the FCM. Spring-seat 38 pivots on pivot pin 39, keeping the forces on the rubber spring in-line with the spring's centerline. If extended arm 37 were allowed to push directly on the rubber spring, the spring would be unevenly loaded (a wedge would be formed), pushing the spring out of alignment and causing overloading to one side. As mentioned before, the springs may be removed, allowing the boom box to function as an unrestricted universal joint. Alternatively, the spring rate may be changed to increase or decrease the amount of force transmitted to the crane's boom. It is also possible to fit a high and a low rate spring set when torque requirements are greater in one direction, such as during CFA drilling. Further, it is possible to operate with one spring, allowing free movement in one direction and restricted movement in the other. It can be seen that this design innovation, using removable rubber springs of various compressive rates, offers considerable adjustability in operation. The springs can also be removed and substituted with mechanical spacers (stops), thereby converting the boom box into a standard two-axis unit.

Figure 6A:
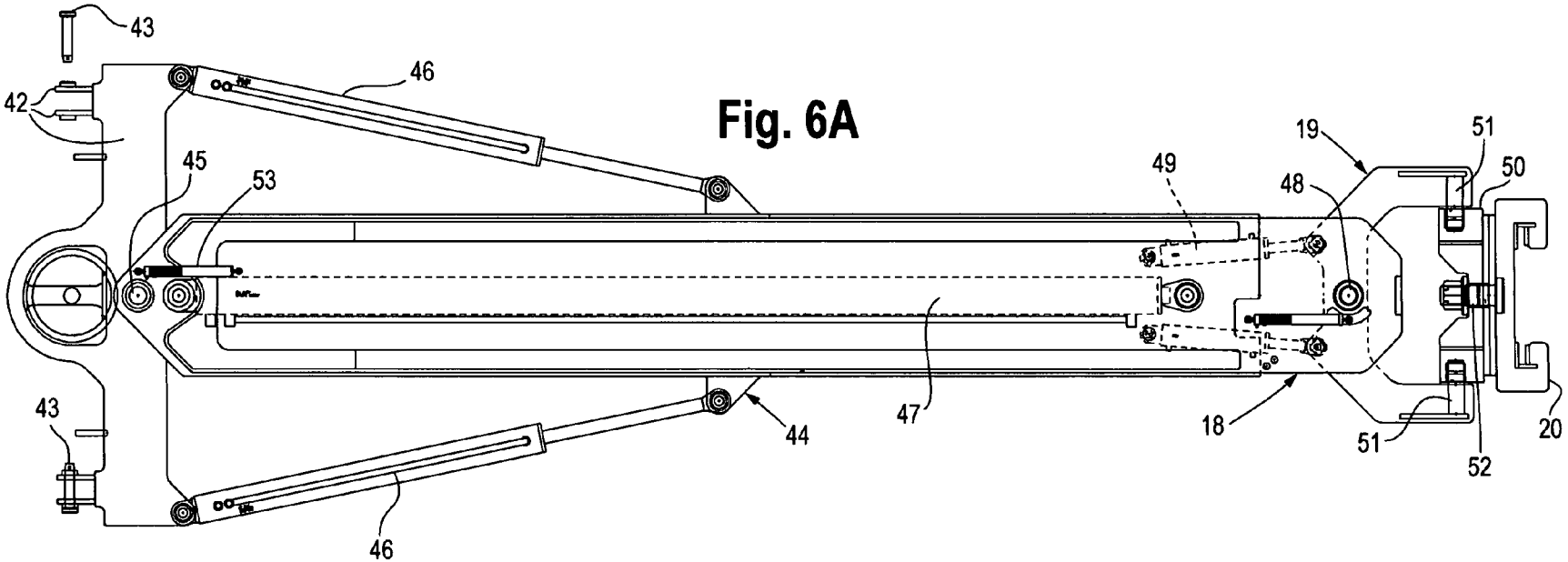
FIGS. 6A (plan view) and 6B-6C (side views, connected and exploded, respectively) are views of a hydraulic spotter shown with two electrical position sensors.
Figure 6B:
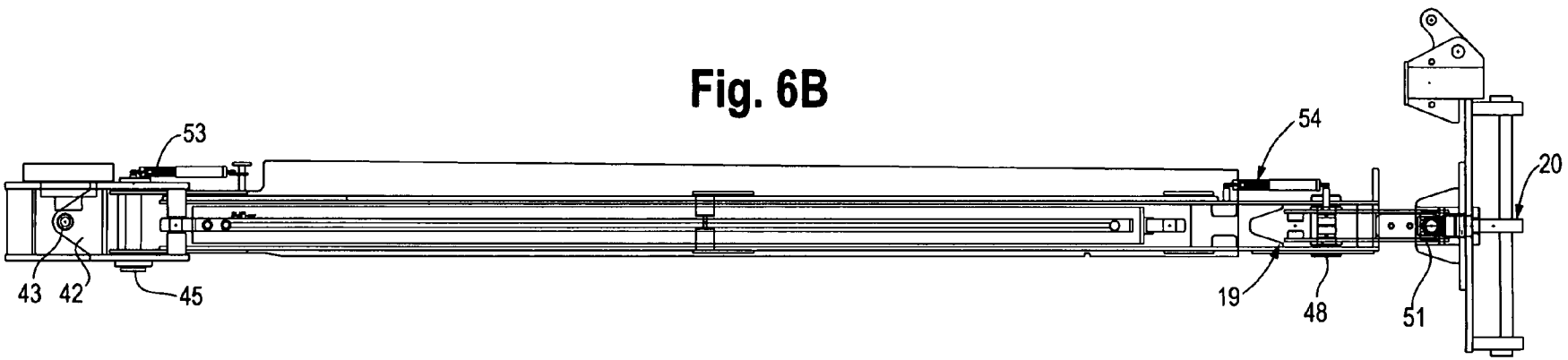
Figure 6C:
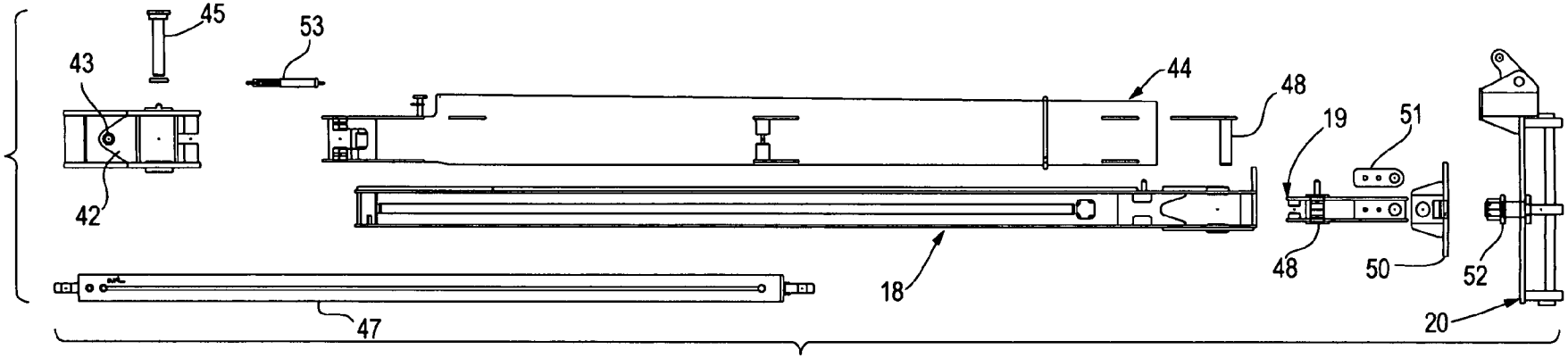

Referring now to FIGS. 6A-6C, the spotter's mainframe 42 may be attached to the crane's revolving mainframe, shown in FIG. 1, by two pivot pins 43. A cable may be used to raise and lower the outer end of the spotter, located at the furthest end from the crane, allowing the spotter to pivot on pins 43. Outer box 44 may be attached to the spotter's mainframe 42; box 44 may be allowed to pivot on pivot pin 45, allowing the two hydraulic cylinders 46 to swing the outer box from side to side. Mounted inside outer box 44 is stinger 18, which may be attached to hydraulic cylinder 47. Hydraulic cylinder 47 may also be attached to mainframe 42 and may be used to extend or retract the stinger. Outer steering arm 19 may be attached to stinger 18, and may be pivoted around pin 48 by using, for example, two hydraulic cylinders 49. Pivoting of the outer steering arm ("Y" axis) may be accomplished under the complete control of the ECM and may constitute the only function over which the operator generally has no or only limited direct control. Limited direct control allows the operator control over the "Y" axis movement of the pile lead and may be limited to a few degrees by measuring the deflection of the upper boom box rubber springs via position sensor 41. Programming of the ECM together with rubber spring rates, determines the actual "Y" axis movement allowed. Direct control of the "Y" axis movement of the pile lead by the operator may be allowed (by ECM programming) if the upper boom box is configured without the two rubber springs, and thus acts as a universal joint. Bottom slider 20 may be attached to the outer steering arm 19 using double pivot link 50. Slider 20 may be attached to the bottom of the pile lead. Double pivot link 50 may be attached to the outer steering arm using, for example, two pivot pins 51, and may be attached to bottom slider 20 using pivot pin 52. This allows unrestricted movement in the "X" and "Z" axis while still allowing powered movement in the "Y" axis via outer steering arm 19.

Two electronic position sensors may be used in the spotter. The "master" position sensor 53 may be attached between mainframe 42 and outer box 44, and may be used to monitor the outer box's swing angle to the left and to the right, as controlled by the operator. "Slave" position sensor 54 may be attached to stinger 18 and outer steering arm 19, and may be used to monitor the angular position of the automatically pivoted outer steering arm, whose movement is controlled by the ECM.

Figure 7A:
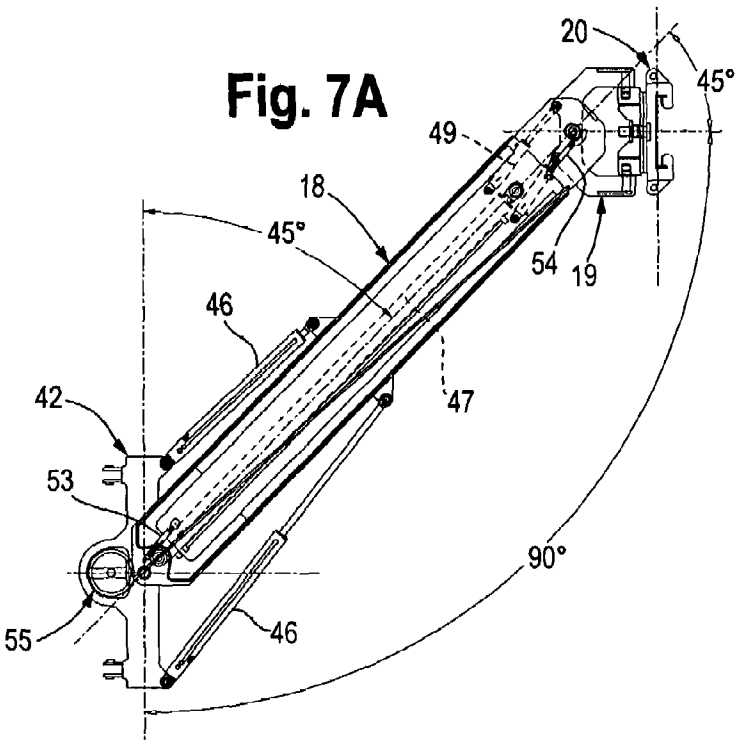
FIGS. 7A-7B are plan views of a hydraulic spotter shown with the stinger fully retracted and swung to right (FIG. 7A) and also fully extended and in-line with the crane's centerline (FIG. 7B).
Figure 7B:
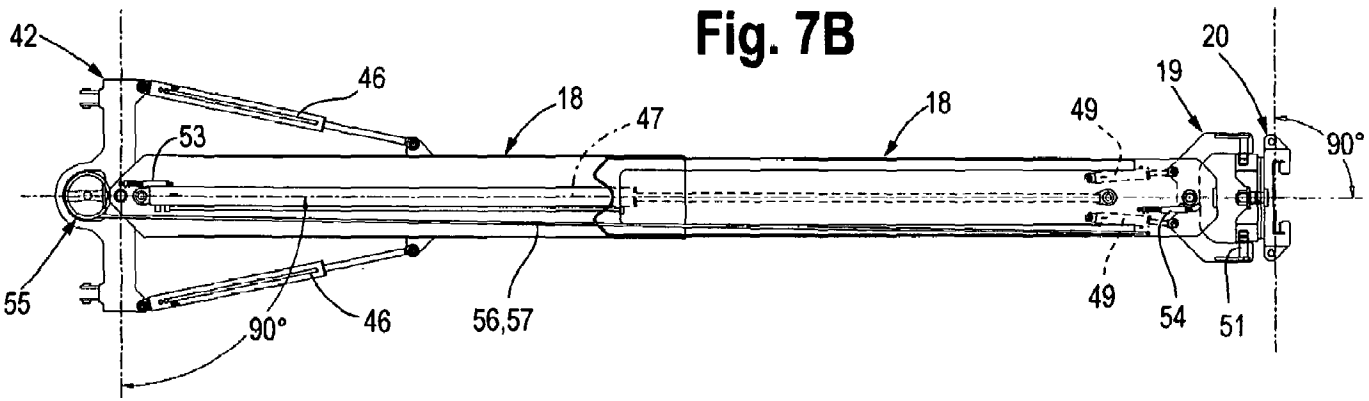

Referring now to FIGS. 7A-7B, the spotter assembly is shown in a fully extended, straight-ahead position, along the centerline of the crane and boom, with bottom slider's 20 front face positioned parallel to the front face of the spotter's mainframe 42 (90 degrees to the crane and boom's centerline). Shown at the top of FIG. 7 is the spotter assembly fully swung to the right (45 degrees) and fully retracted. The ECM has maintained the bottom slider's 20 front face parallel to the front face of the spotter's mainframe (both have turned 45 degrees, but in opposite directions).

The centerline of the pile lead may be positioned parallel to the centerline of the crane. In the straight-ahead position, sensors 53 and 54 preferably measure, for example, 16 inches between their attached spherical ball joints. In the preferred embodiment this was found to equal a reference voltage, supplied by both of the sensors to the ECM, of 2.5 volts. If the outer steering arm is not in the straight-ahead position, the voltage may be slightly more or less than 2.5 Volts. The ECM ray be used to energize the electro/hydraulic system and supply hydraulic oil to hydraulic cylinders 49, which may be used to rotate outer steering arm 19 in the correct direction until (e.g.) 2.5 Volts are reached. When the crane's operator swings the spotter to the left or right, the position sensor's 53 ("master") length may be decreased (e.g., swing left, 0.5 Volts Min.) or increased (e.g., swing right 4.5 Volts Max.). The ECM may be designed to always turn outer steering arm 19 so that position sensor 54 matches the same voltage as position sensor 53. This works due to the fact that sensor 53 is positioned to the left of the spotter's centerline, while sensor 54 is positioned to the right of the centerline. When the spotter is fully swung to the left, position sensors 53 and 54, in the preferred embodiment described here, measure 14 inches in length, and when the spotter is fully swung to the right, position sensors 53 and 54 measure 18 inches in length.

As mentioned above, external forces and/or hydraulic drift in cylinders 49 due to hydraulic circuit leakage may cause outer steering arm 19 to rotate, changing the length of position sensor 54, which will result in a change in voltage output. In this event, the ECM may be used to signal the hydraulic control valve to supply correction oil to hydraulic cylinders 49, thereby returning the outer steering arm to the correct position.

Referring back to FIGS. 5A-5B, the ECM monitors position sensor 41, which is mounted in boom box 14. The voltage output of sensor 41 may be used to correct twist in the pile lead assembly, which may be caused by offset loads or drilling torque. Deflection of the rubber springs may change the sensor's length, so that its voltage output changes from 2.5 Volts. Using proper programming, the ECM may be caused to compare the input from sensor 41 to the input from sensor 54, and then to turn outer steering arm 19 in the correct direction until sensor 41 is again at (e.g.) 2.5 Volts, When boom box 14 is being used as a universal joint, with no rubber springs, position sensor's 41 input to the ECM may be ignored, allowing position sensor 54 to monitor the position of outer steering arm 19.

The ECM may be programmed to accommodate all of the various setups. Setups may be electronically displayed on a touch screen located in front of the crane's operator; readouts from the various sensors may be displayed on this screen as well, or on an alternative screen. Other sensors may be added to monitor auger speed, hydraulic drive pressure (auger torque), boom angle, cable-tension, winch position (depth of drilling or pile driving depth), etc., as desired. Angles may be displayed on the screen, in real time, from all three position sensors.

Referring back to FIGS. 7A-7B, it may be useful to attach to the spotter's mainframe 42 a spring retractable hose reel 55 with two hydraulic hoses 56 for supplying hydraulic oil for the cylinders 49, and one electrical cable 57 for position sensor 54. The hoses and electrical cable may be molded together and attached to the outer end of stinger 18. The reel may be wrapped several times, against spring tension, with the molded cable assembly. Extending the stinger pulls the hose assembly, rotating reel 55 and further tensioning the hose reel's tension spring. Thus, the tensioned spring may be caused to pull on the hose assembly when stinger 18 is retracted, keeping the hose assembly tensioned.

The ECM program may be programmed to perform an automatic setup of the three position sensors. The calibration mode, preferably password-protected, may be selected on the touch screen when setting up or rigging the crane, pile lead, spotter and boom box. Boom box sensor 41 may be attached to its electrical cable before the boom box is attached to the crane's boom tip. Referring back to FIGS. 5A-5B, rubber springs 39 may be employed to retain position sensor 41 in the zero deflection position which, in the preferred embodiment, should theoretically be 2.5 Volts. Due to rubber spring compression, as affected by age, electrical on the position sensor, and normal wear on the mechanical components, reference voltages may shift. Zero or the straight-ahead position, as an example, may have shifted from 2.5 Volts to 2.3 Volts. A mechanical lock pin (not shown) may be inserted between upper frame 33 and lower frame 34 to establish the correct alignment or straight-ahead position. In the calibration mode, the actual voltage may be stored in the memory of the ECM.

Position sensors 53 and 54 attached to spotter 9 may also be tested in the calibration mode. Referring to FIG. 1, the spotter may be suspended by cable 11 before being attached to pile lead assembly 16. The crane's operator may swing the spotter fully to the left and hold this position for 5 seconds, as displayed on the touch screen. The spotter may then fully swing the spotter to the right and again hold this position for 5 seconds. The ECM may be programmed to calculate the center point of the minimum and maximum voltage from position sensor 53 and store this value into memory. This is the straight-ahead position. Calibration of position sensor 54, which monitors the position of outer steering arm 19, is identical to position sensor 53. In the calibration mode, the ECM may be programmed to allow the operator direct control of the outer steering arm, allowing it to be swung fully to the left and right.

The ECM may also be programmed to monitor the position of all the sensors and to warn the crane's operator of out-of-limits operation. The fault may be shown on the operator's screen. Some faults may be displayed as warnings, while other faults may result in the shut down of the system until repairs are made to correct the problem.

It will be appreciated that one or more pneumatic or hydraulic cylinders may be used in place of the rubber springs. The hydraulic cylinder option would be more viable, as the cylinder's size would be relatively small and generally hydraulic oil is readily available from the crane. The cylinders could be single or double acting and in both cases the air/oil flow could be restricted in and out of both cylinders to provide dampening. At least one accumulator could be used to provide a rising rate similar to the rubber springs. Another option when using air or hydraulic cylinders would be to set the cylinder's control pressure (air or oil pressure) to a fixed pressure setting (no rising rate or accumulators(s)), thereby limiting the amount of induced torque applied to the cranes boom to a constant fixed value. Rubber springs may be preferred, however, as maintenance and cost will likely be lower than cylinders requiring air/hydraulic control systems.

The present invention could also be adapted for use with a stationary crane such as one mounted to a pedestal. Even devices not typically termed "cranes" could be used with the present invention. For example, a hydraulic excavator could be fitted with a spotter and a boom box, rather than using a crane. An excavator boom may be fabricated out of steel plates and may be manufactured in various shapes. Further, a "lattice boom" need not be used with the present invention. While lattice booms are generally constructed from alloy hollow section tubing or angle steel and are triangulated in construction, the boom structure could also consist of a tubular or boxed section which may not be termed a "lattice boom" in common industry usage.

The above description is not intended to limit the meaning of the words used in the following claims that define the invention. Other systems, methods, features, and advantages of the present invention will be, or will become, apparent to one having ordinary skill in the art upon examination of the foregoing drawings, written description and claims, and persons of ordinary skill in the art will understand that a variety of other designs still falling within the scope of the following claims may be envisioned and used. It is contemplated that these or other future modifications in structure, function or result will exist that are not substantial changes and that all such insubstantial changes in what is claimed are intended to be covered by the claims.

We claim:

1. A method for using a crane having a main body and a boom supporting a pile lead, comprising the steps of:

providing a hydraulically operated mechanical spoiler arm attached between the crane body and the pile lead;

providing at least two electronic position sensors associated with the spoiler arm, and an electronic control system in electrical communication with the at least two electronic position sensors;

using the electronic control system and the at least two spotter arm electronic position sensors to obtain angular information based on measuring angular relationships between the pile lead and the spotter arm when the pile lead is swung to the left or right of a centerline of the crane;

using the electronic control system and the angular information to automatically maintain a front face of the pile lead approximately perpendicular to the centerline, thereby limiting torque induced in the boom during crane usage;

providing a boom box connected to the boom and in electrical communication with the electronic control system, the boom box having one or more electronic position sensors; and fitting the boom box with one or more rubber springs, and thereby enabling controlled pile lead deflection in either or both of clockwise or counterclockwise directions while limiting load transmitted to the boom to a maximum allowable load.

2. The method of claim 1, wherein a plurality of rubber springs are employed having differing load ratings.

3. The method of claim 1, wherein the one or more rubber springs are removable, allowing the boom box to freely pivot on all three axes.

4. The method of claim 1, wherein the load ratings of the one or more rubber springs range from between about 6,000-125,000 pounds of force.

5. The method of claim 1, wherein the load rating(s) of the one or more rubber springs employed when pile-lead deflection is in the clockwise direction differ from the load rating(s) of the one or more rubber springs employed when pile-lead deflecting in the counterclockwise direction.

6. The method of claim 1 further comprising the step of compressing the one or more rubber springs while limiting their pinching or side-loading, using a pivoting spring seat operatively attached to the boom box.

7. The method of claim 1, further comprising the step of monitoring deflection in the one or more rubber springs using the electronic control system and, based at least in part on this feedback, limiting the ability of a crane operator to control movement of the spoiler arm.

8. The method of claim 1, further comprising the step of removing the one or more rubber springs and using the electronic control system to enable a crane operator to control movement of the spoiler arm.

9. A crane having a main body and boom supporting a pile lead, comprising:

a hydraulically operated mechanical spotter arm attached between the crane body and the pile lead;

at least two electronic position sensors associated with the spotter arm and used to measure angular relationships between the pile lead and the spotter arm;

an electronic control system in electrical communication with the at least two electronic position sensors, wherein when the pile lead is swung left or right of a centerline of the crane, information from the sensors is used by the electronic control system to automatically maintain a front face of the pile lead approximately perpendicular to the centerline, thereby limiting torque induced in the boom during crane usage; and a boom box connected to the boom and in electrical communication with the electronic control system, the boom box having one or more electronic position sensors, wherein the boom box is fitted with one or more rubber springs enabling controlled pile lead deflection in either or both of clockwise or counterclockwise directions while limiting load transmitted to the boom to a maximum allowable load.

10. The crane of claim 9, wherein a plurality of rubber springs are employed having differing load ratings.

11. The crane of claim 9, wherein the one or more rubber springs are removable, allowing the boom box to freely pivot on all three axes.

12. The crane of claim 9, wherein the load ratings of the one or more rubber springs range from between about 6,000-125,000 pounds of force.

13. The crane of claim 9, wherein the load rating(s) of the one or more rubber springs employed when pile-lead deflection is in the clockwise direction differ from the load rating(s) of the one or more rubber springs employed when pile-lead deflecting in the counterclockwise direction.

14. The crane of claim 9, further comprising a pivoting spring seat operatively attached to the boom box, to permit compression of the one or more rubber springs while limiting their pinching or side-loading.

15. The crane of claim 9, wherein the electronic control system monitors deflection in the one or more rubber springs and, based at least in part on this feedback, limits the ability of a crane operator to control movement of the spotter arm.

16. The crane of claim 9, wherein the one or more rubber springs are removable and the electronic control system enables a crane operator to control movement of the spotter arm.

* * * * *